US005489347A

United States Patent [19]

Himuro et al.

[11] Patent Number: 5,489,347

[45] Date of Patent: Feb. 6, 1996

[54] ALUMINUM ALLOY FIN MATERIAL FOR HEAT-EXCHANGER

[75] Inventors: Fujio Himuro, Kiyotakitanze; Takeyoshi Doko, Kiyotakinakayasudo, both of Japan

[73] Assignees: Furukawa Electric Co., Ltd.; Nippondenso Co., Ltd., both of Japan

[21] Appl. No.: 281,154

[22] Filed: Jul. 27, 1994

Related U.S. Application Data

[63] Continuation of Ser. No. 51,242, Apr. 23, 1993, abandoned.

[30] Foreign Application Priority Data

| | | | |
|---|---|---|---|
| Aug. 5, 1992 | [JP] | Japan | 4-229314 |
| Aug. 20, 1992 | [JP] | Japan | 4-244145 |
| Dec. 8, 1992 | [JP] | Japan | 4-352025 |
| Jan. 22, 1993 | [JP] | Japan | 5-025955 |
| Jan. 29, 1993 | [JP] | Japan | 5-034222 |

[51] Int. Cl.[6] ..... C22C 21/00; C22C 21/02

[52] U.S. Cl. ..... 148/437; 148/440; 420/540; 420/541; 420/542; 420/546; 420/547; 420/548; 420/550; 420/551; 420/552; 420/553

[58] Field of Search ..... 148/437, 440; 420/540, 541, 542, 546, 547, 548, 550, 551, 552, 553

[56] References Cited

U.S. PATENT DOCUMENTS 3,920,411 11/1975 Schoerner et al. ..... 420/550

FOREIGN PATENT DOCUMENTS 3-104838 5/1991 Japan .
1524355 9/1978 United Kingdom .

*Primary Examiner*—David A. Simmons
*Assistant Examiner*—Robert R. Koehler
*Attorney, Agent, or Firm*—Breiner & Breiner

[57] ABSTRACT

An aluminum alloy fin material for heat-exchanger with excellent thermal conductance and strength after brazing comprising 0.005 to 0.8 wt. % of Si, 0.5 to 1.5 wt. % of Fe, 0.1 to 2.0 wt. % of Ni, and a balance of Al and inevitable impurities is disclosed. The aluminum alloy fin material can additionally contain 0.01 to 0.2 wt. % of Zr and/or at least one element of the group consisting of not more than 2.0 wt. % of Zn, not more than 0.3 wt. % of In, and not more than 0.3 wt. % of Sn.

4 Claims, 1 Drawing Sheet

ALUMINUM ALLOY FIN MATERIAL FOR HEAT-EXCHANGER

This is a continuation of application Ser. No. 08/051,242 filed on Apr. 23, 1993, abandoned.

BACKGROUND OF THE INVENTION

The present invention relates to an aluminum alloy fin material for heat-exchanger with high thermal conductance. It relates, in more detail, to an aluminum alloy fin material to be used for fins of radiator being a heat-exchanger for cars, heater, condenser and the like produced particularly by brazing method.

The majority of heat-exchangers for cars uses Al or Al alloy and is produced by brazing method. Usually, for brazing, Al-Si type filler alloy is used, hence the brazing is performed at high temperature of around 600° C. In the heat-exchangers of radiator etc., as shown in FIG. 1 for example, a thin-wall fin (2) machined in corrugated shape is formed unitedly between a plurality of flat tubes (1), both ends of said flat tubes (1) open respectively in spaces constituted by header (3) and tank (4), high-temperature refrigerant is fed from the space of one tank side to the space of other tank (4) side through flat tubes (1), thereby heat-exchanging at the portions of flat tube (1) and thin-wall fin (2), and the refrigerant having become low temperature is circulated again.

Now, recently, the heat-exchanger is in the direction of lightening in weight and miniaturizing, and, for this, improved thermal efficiency of heat-exchanger is required and improved thermal conductance of material is desired. In particular, improved thermal conductance of fin material is investigated and a fin material of alloy with alloy composition brought close to pure aluminum is proposed as a high-thermal conductance fin. When thinning the fin, however, there are problems that, if the strength of fin is insufficient, then the fin collapses on assembling of heat-exchanger or it ends up to break on using as a heat-exchanger. In particular, in the case of pure aluminum type alloy fin, it has a drawback of insufficient strength, hence a fin with high strength and improved thermal conductance has not yet been developed. This is because of that the addition of alloy elements such as Mn is effective for high strength or, since the production process includes brazing to heat near 600° C., the elements added to alloy form the solid solution during brazing to hinder the improvement in thermal conductance.

In view of this situation, the inventors considered that, for developing a fin material with high strength and thermal conductance after soldering, the problems could be solved, if improving the thermal conductance by making the quantities of Si and Fe appropriate and further if possible to find the alloy elements having significant improvement effect on strength without decreasing the thermal conductance, leading to the invention.

SUMMARY OF THE INVENTION

Aluminum alloy fin materials for heat-exchanger with excellent thermal conductance and strength after brazing have been developed according to the invention. The first of the invention provides an aluminum alloy fin material for heat-exchanger, characterized by comprising 0.005 to 0.8 wt. % of Si, 0.5 to 1.5 wt. % of Fe, 0.1 to 2.0 wt. % of Ni, and the balance of Al and inevitable impurities. The second of the invention provides an aluminum alloy fin material for heat-exchanger, characterized by comprising 0.005 to 0.8 wt. % of Si, 0.5 to 1.5 wt. % of Fe, 0.1 to 2.0 wt. % of Ni, 0.01 to 0.2 wt. % of Zr, and the balance of Al and inevitable impurities. Moreover, the third of the invention provides an aluminum alloy fin material for heat-exchanger, characterized by comprising 0.005 to 0.8 wt. % of Si, 0.5 to 1.5 wt. % of Fe, 0.1 to 2.0 wt. % of Ni, further at least one element selected from the group consisting of not more than 2.0 wt. % of Zn, not more than 0.3 wt. % of In and not more than 0.3 wt. % of Sn, and the balance of Al and inevitable impurities. Furthermore, the fourth of the invention provides an aluminum alloy fin material for heat-exchanger, characterized by comprising 0.005 to 0.8 wt. % of Si, 0.5 to 1.5 wt. % of Fe, 0.1 to 2.0 wt. % of Ni, 0.01 to 0.2 wt. % of Zr, further at least one element selected from the group consisting of not more than 2.0 wt. % of Zn, not more than 0.3 wt. % of In and not more than 0.3 wt. % of Sn, and the balance of Al and inevitable impurities.

DETAILED DESCRIPTION OF THE INVENTION

Figure 1:
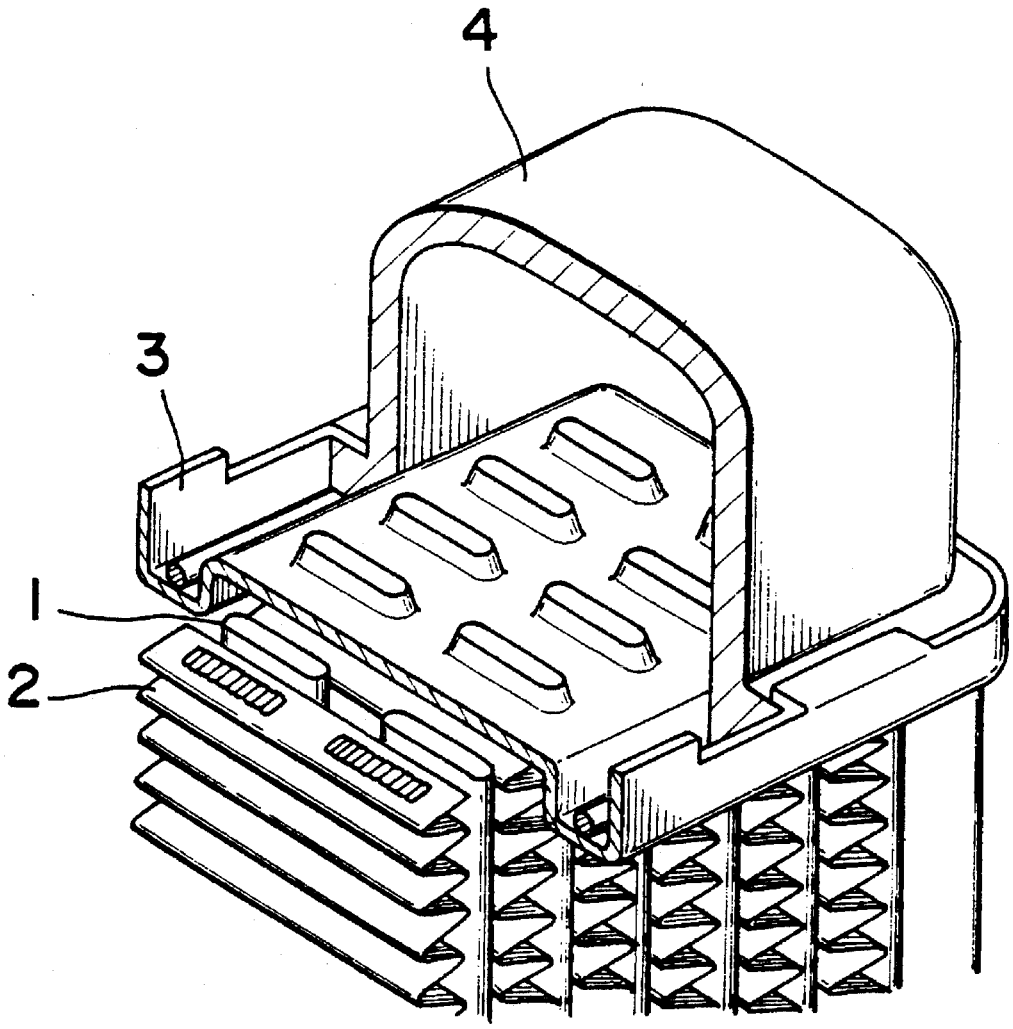
FIG. 1 is an oblique view of partial section showing radiator.

In following, illustration will be made about the role of addition elements to the inventive fin materials and the reasons of restriction in the alloy compositions.

Si allows to improve the strength through the addition thereof. Since Si has an action to promote the precipitation of Fe and Ni particularly when coexisting with Fe and Ni in addition to improving the strength through the solid-solution hardening of Si itself, it increases the intermetallic compounds contributing to the reinforcement of dispersion to improve the strength. Further, since Si decreases the quantity of solid solution of Fe and Ni formed in the fin material by promoting the precipitation of Fe and Ni, it improves the thermal conductance. If Si is under 0.005 wt. %, not only the effect on strength improvement will be insufficient, but also it is required to produce the fin using high-purity metal, which is unsuitable in the aspect of cost. If over 0.8 wt. %, the diffusion of filler will become significant on brazing under heat to decrease the thermal conductance in addition to the solderability.

Hence, the range of Si is made to be from 0.005 to 0.8 wt. %, but the appropriate quantity of Si varies somewhat depending on the characteristics required for the fin. First, when the quantity of Si is low, a fin material with specifically excellent thermal conductance of fin can be obtained due to decreased quantity of Si and further, since the natural potential of fin becomes baser, a fin advantageous in the point of sacrificial effect can be obtained. For such characteristics, a range from 0.05 to 0.2 wt. % shows stable characteristics, in particular. Moreover, when the quantity of Si is high, a fin, the thermal conductance of which is not so high as that of former, but which has excellent strength after soldering can be obtained. For such characteristics, a range from 0.4 to 0.6 wt. % shows stable characteristics, in particular.

Fe makes the solid-solution hardening in a certain amount in alloy, and the remainder exists as intermetallic compounds. The former improves the strength, but significantly decreases the thermal conductance. The latter slightly improves the strength through the reinforcement of dispersion, but has an action inversely to decrease the improvement effect on strength due to Si addition by forming intermetallic compound with Si. Here, if the addition level of Fe is under 0.5 wt. %, the improvement effect on strength will be insufficient, and, if over 1.5 wt. %, the moldability will deteriorate resulting in difficult corrugating molding of fin.

For Ni, it has become clear as a result of diligent investigations by the inventors that it has an effect to improve the strength without decreasing the thermal conductance. This is an important element in the invention. Namely, Ni improves the strength through the solid-solution hardening, but, at the same time, it has an action to decrease the amount of solid solution of Fe equivalent to the amount of solid solution of Ni. While Fe and Ni have almost the same effect on the improvement in strength on forming solid solution, the decrease in the thermal conductance is far less for Ni. Hence, when adding Ni to an alloy containing said quantity of Fe, the strength improves without decreasing thermal conductance. And, if the addition level of Ni is under 0.1 wt. %, the effect will be insufficient, and, if adding over 2.0 wt. %, the moldability will deteriorate resulting in difficult corrugating molding of fin.

Here, as an alloy for heat-exchanger added with Ni to pure aluminum, we can find that shown in Japanese Unexamined Patent Publication No. Sho 57-60046. Although this invention relates to an alloy for heat-exchanger, the fact that it considers a constitutional member of pathway of refrigerant for its application and does not contemplate the fin is obvious based on that this invention provides the improvements in corrosion resistance and sag property, and it has no description about the sacrificial anode effect (which aggravates the corrosion resistance) and the thermal conductance required for fin material and the plate thickness shown in examples is much thicker over fin material.

Further, in the invention of Japanese Unexamined Patent Publication No. Sho 57-60046, any way of thinking as an alloy for fin material with excellent thermal conductance is not described at all, and any description taken hold of the relationship between the quantity of Fe and the quantity of Ni being a basis of the invention is not made at all. That is to say, the invention of said publication and the present invention are quite different in the application and the way of thinking.

Still more, with respect to the alloy composition, the invention of Japanese Unexamined Patent Publication No. Sho 57-60046 considers Si and Fe to be impurity elements, thus quite differs from the present invention, which adds these elements considering as positive addition elements.

Besides, Co is an element to be expected to exert the same effect as Ni, and not more than 2.0 wt. % of Co may safely be added besides Ni in the invention.

In some cases of the invention, 0.01 to 0.2 wt. % of Zr are added further, Zr has a function to coarsen the recrystallized grains produced on soldering and to prevent the sag property of fin and the diffusion of solder into fin. Since the inventive alloy contains relatively large quantities of Fe, the recrystallized grains often become fine, and the addition of Zr is beneficial in such cases. And, if adding under 0.01 wt. % of Zr, its function will not be enough. According to the investigations by the inventors, Zr has little function to improve the strength and is an element to decrease the thermal conductance, hence the upper limit was determined at 0.2 wt. %.

To the inventive alloy, at least one element selected from the group consisting of not more than 2.0 wt. % of Zn, not more than 0.3 wt. % of In and not more than 0.3 wt. % of Sn are added in some cases. These are added to give the sacrificial anode effect to fin material and, if adding over the quantities aforementioned, respectively, the thermal conductance will decrease.

Now, the inevitable impuirities and the elements to be added for the reasons other than above include Ti, B, etc. added to make the texture of ingot fine, and these elements may be safely added, if under 0.03 wt. %, respectively. Moreover, when adding the elements such as Cu, Mn, Mg, Na, Cd, Pb, Bi, Ca, Li, Cr, K and V for the reasons of improvement in strength, prevention of ingot from cracking, improvement in moldability and the like, addition of not more than 0.03 wt. % is required condition, respectively. This is because of that, if adding over 0.03 wt. %, all of these elements will decrease the thermal conductance.

The alloy composition of the invention is as above. The inventive fin material can be used as a bare material and can also be used as a core material of brazing sheet fin. For the soldering material in the latter case, the soldering alloy used traditionally may be used as it is.

For the heat-exchanger using the inventive fin material, radiator for cars, condenser, evaporator, oil cooler, etc. can be mentioned, but the heat-exchangers are not confined to these.

Moreover, as the methods of soldering the inventive fin, noncorrosive flux brazing, flux brazing, vacuum brazing, etc. employed traditionally are all possible.

The inventive fin can be produced through the processes of ingot production by semi-continuous casting, hot rolling, cold rolling and annealing or can be produced also through the processes of continuous casting and rolling, cold rolling and annealing.

In following, the invention will be illustrated concretely based on examples.

EXAMPLE

Aluminum alloy fin materials (sheet thickness: 60 μm, H14 refining) with alloy compositions shown in Table 1 and Table 2 were fabricated according to usual method. Of these fin materials, the strength, electroconductivity and natural potential used saturated calomel electrode in 5% aqueous solution of NaCl, which was conducted on a part of specimens, after soldering under heat were determined. The conditions of soldering under heat were for 5 minutes at 600° C. in nitrogen gas. The results are shown in Table 3 and Table 4.

Here, the electroconductivity is an index of thermal conductance and, if the electroconductivity of fin improves by 5% IACS, then the thermal efficiency of heat-exchanger improves by 1% or so.

TABLE 1

| | Alloy composition (wt. %) | | | | | | | | | | |
|---|---|---|---|---|---|---|---|---|---|---|---|
| No. | Si | Fe | Ni | Zr | Zn | In | Sn | Mn | Cu | Ti | Al |
| | | | | | Inventive example | | | | | | |
| 1 | 0.10 | 1.1 | 0.4 | — | — | — | — | — | — | — | Balance |
| 2 | 0.10 | 1.1 | 0.4 | — | 0.8 | — | — | — | — | — | " |
| 3 | 0.10 | 1.1 | 0.4 | — | — | 0.1 | 0.1 | — | — | — | " |
| 4 | 0.10 | 1.1 | 0.4 | 0.10 | — | — | — | — | — | 0.01 | " |
| 5 | 0.05 | 0.7 | 0.8 | 0.10 | 1.1 | — | — | — | — | — | " |
| 6 | 0.05 | 1.0 | 1.0 | — | — | — | — | — | — | — | " |
| 7 | 0.10 | 0.65 | 0.8 | — | — | — | 0.1 | — | — | — | " |
| 8 | 0.20 | 1.0 | 0.5 | — | — | 0.001 | — | — | — | — | " |
| 9 | 0.20 | 1.0 | 1.0 | — | 0.8 | — | — | — | — | 0.01 | " |
| 10 | 0.25 | 0.75 | 0.4 | — | — | 0.002 | — | — | — | — | " |
| 11 | 0.25 | 1.1 | 0.3 | — | 0.8 | — | — | — | — | 0.01 | " |
| 12 | 0.01 | 0.8 | 0.4 | — | — | — | — | — | — | — | " |
| 13 | 0.03 | 0.8 | 0.4 | — | 0.4 | — | — | — | — | — | " |
| 14 | 0.03 | 0.8 | 0.4 | — | — | 0.01 | 0.01 | — | — | — | " |
| 15 | 0.01 | 1.1 | 0.4 | 0.10 | — | — | — | — | — | 0.01 | " |
| 16 | 0.02 | 0.6 | 0.8 | — | — | — | 0.1 | — | — | — | " |
| 17 | 0.01 | 0.8 | 0.8 | — | — | — | — | — | — | — | " |
| 18 | 0.02 | 1.1 | 0.3 | — | 0.4 | — | — | — | — | — | " |
| 19 | 0.03 | 1.4 | 0.3 | — | — | 0.001 | — | — | — | — | " |
| 20 | 0.25 | 1.4 | 0.3 | — | 0.1 | 0.002 | 0.001 | — | — | — | " |
| 21 | 0.50 | 1.0 | 0.4 | — | — | — | — | — | — | — | " |
| 22 | 0.50 | 1.0 | 0.4 | — | 0.8 | — | — | — | — | 0.01 | " |

TABLE 2

| | Alloy composition (wt %) | | | | | | | | | | |
|---|---|---|---|---|---|---|---|---|---|---|---|
| No. | Si | Fe | Ni | Zr | Zn | In | Sn | Mn | Cu | Ti | Al |
| | | | | | Inventive example | | | | | | |
| 23 | 0.50 | 1.0 | 0.4 | — | — | 0.1 | 0.1 | — | — | 0.01 | Balance |
| 24 | 0.50 | 1.0 | 0.3 | 0.10 | — | — | — | — | — | 0.01 | " |
| 25 | 0.75 | 1.15 | 0.4 | — | — | — | 0.1 | — | — | — | " |
| 26 | 0.6 | 0.6 | 0.6 | — | — | 0.1 | — | — | — | 0.01 | " |
| 27 | 0.6 | 0.9 | 0.4 | — | — | — | — | — | — | — | " |
| 28 | 0.6 | 1.0 | 0.6 | — | 1.1 | — | — | — | — | — | " |
| 29 | 0.6 | 1.1 | 0.4 | — | — | 0.002 | — | — | — | 0.01 | " |
| 30 | 0.55 | 0.7 | 0.3 | — | — | — | — | — | — | 0.01 | " |
| 31 | 0.45 | 0.7 | 1.0 | — | — | — | — | — | — | 0.01 | " |
| 32 | 0.4 | 0.6 | 0.6 | — | 1.1 | — | — | — | — | — | " |
| 33 | 0.4 | 0.9 | 0.4 | 0.1 | — | — | — | — | — | — | " |
| 34 | 0.4 | 1.0 | 0.8 | — | 1.0 | — | — | — | — | 0.01 | " |
| 35 | 0.4 | 1.1 | 0.3 | — | — | 0.1 | — | — | — | — | " |
| 36 | 0.7 | 0.6 | 0.5 | — | — | 0.005 | — | — | — | — | " |
| 37 | 0.65 | 1.3 | 0.2 | 0.15 | 0.1 | — | — | — | — | — | " |
| 38 | 0.35 | 1.2 | 0.9 | 0.05 | — | — | 0.002 | — | — | — | " |
| | | | | | Conventional example | | | | | | |
| 39 | 0.5 | 0.5 | — | 0.15 | 1.0 | — | — | — | — | 0.01 | " |
| 40 | 0.4 | 0.6 | — | — | 1.0 | — | — | 1.1 | 0.1 | 0.01 | " |
| | | | | | Comparative example | | | | | | |
| 41 | 0.002 | 0.8 | 0.03 | — | 1.0 | — | — | — | — | — | " |
| 42 | 0.2 | 0.45 | 0.4 | — | — | — | — | — | — | — | " |
| 43 | 0.1 | 0.1 | 0.6 | — | 1.0 | — | — | — | — | — | " |
| 44 | 0.5 | 0.1 | 0.6 | — | — | — | — | — | — | — | " |
| 45 | 1.0 | 0.4 | 0.6 | — | — | — | — | — | — | — | " |
| 46 | 1.0 | 1.1 | 0.3 | — | 1.0 | — | — | — | — | — | " |
| 47 | 0.7 | 1.8 | 0.6 | — | 1.0 | — | — | — | — | — | " |
| 48 | 0.03 | 0.8 | 0.03 | — | 1.0 | — | — | — | — | — | " |
| 49 | 0.03 | 0.8 | 2.5 | — | 1.0 | — | — | — | — | — | " |
| 50 | 0.1 | 0.45 | 0.4 | — | — | — | — | — | — | — | " |
| 51 | 0.5 | 1.0 | 2.5 | — | — | — | — | — | — | — | " |

TABLE 3

| No. | Tensile strength (MPa) | Electro-conductivity (% IACS) | Natural potential (mV) |
|---|---|---|---|
| | Inventive example | | |
| 1 | 125 | 59 | −790 |
| 2 | 125 | 58 | −850 |
| 3 | 125 | 58 | −860 |
| 4 | 125 | 56 | −790 |
| 5 | 120 | 57 | −870 |
| 6 | 115 | 60 | −800 |
| 7 | 120 | 59 | −790 |
| 8 | 130 | 58 | −830 |
| 9 | 130 | 57 | −850 |
| 10 | 130 | 57 | −840 |
| 11 | 125 | 56 | −860MS |
| 12 | 110 | 62 | −800 |
| 13 | 115 | 59 | −860 |
| 14 | 115 | 60 | −850 |
| 15 | 115 | 61 | −800 |
| 16 | 110 | 61 | −850 |
| 17 | 120 | 61 | −810 |
| 18 | 120 | 59 | −860 |
| 19 | 110 | 59 | −850 |
| 20 | 130 | 56 | −860 |
| 21 | 140 | 57 | — |
| 22 | 140 | 57 | — |

TABLE 4

| No. | Tensile strength (MPa) | Electro-conductivity (% IACS) | Natural potential (mV) |
|---|---|---|---|
| | Inventive example | | |
| 23 | 140 | 57 | — |
| 24 | 145 | 56 | — |
| 25 | 145 | 56 | — |
| 26 | 140 | 56 | — |
| 27 | 140 | 56 | — |
| 28 | 137 | 57 | — |
| 29 | 137 | 58 | — |
| 30 | 135 | 57 | — |
| 31 | 140 | 57 | — |
| 32 | 130 | 58 | — |
| 33 | 140 | 56 | — |
| 34 | 145 | 57 | — |
| 35 | 135 | 58 | — |
| 36 | 135 | 56 | — |
| 37 | 140 | 55 | — |
| 38 | 143 | 55 | — |
| | Conventional example | | |
| 39 | 90 | 52 | −840 |
| 40 | 115 | 40 | −810 |
| | Comparative example | | |
| 41 | 70 | 60 | −760 |
| 42 | 80 | 58 | −790 |
| 43 | 75 | 59 | — |
| 44 | 85 | 60 | — |
| 45 | 130 | 49 | — |
| 46 | 130 | 45 | — |
| 47 | 135 | 52 | — |
| 48 | 75 | 60 | — |
| 49 | 120 | 58 | — |
| 50 | 85 | 61 | — |
| 51 | 140 | 55 | — |

As evident from Table 3 and Table 4, there are no fin materials of conventional examples and comparative examples excellent in both tensile strength and electroconductivity, whereas the fin materials of the inventive examples show excellent values in both tensile strength and electroconductivity.

Here, No. 39 deals with a fin material of conventional pure aluminum type alloy with excellent thermal conductance and No. 40 deals with a fin material of conventional Al-Mn type alloy. Whereas, No. 1 through 20 are examples with relatively low quantity of Si of the invention. They are excellent in the thermal conductance and strength over conventional pure aluminum type alloy, while having the same degree of sacrificial effect as that of conventional material, and have characteristics that the strength is equal to that of conventional Al-Mn type alloy and the thermal conductance is very excellent. Moreover, No. 21 through 38 deal with fin materials with relatively high quantity of Si in the invention. They have the thermal conductance equal or superior to that of conventional pure aluminum type alloy and are very excellent in the strength. They also have characteristics that the strength is equal or superior to that of conventional Al-Mn type alloy and the thermal conductance is very excellent. In No. 21 through 38, those added with any of Zn, In and Sn have the same sacrificial effect as that of conventional materials, though the potentials are not listed. Those without said elements are poor in the sacrificial effect, hence they have to be used for the heat-exchangers not requiring the sacrificial effect as fins, leading to the limited applications.

Comparative example No. 41 uses high-purity metal, which is problematic in cost. Moreover, the corrugating molding was performed with all fins and it was found that the fin materials of No. 47, 49 and 51 generated the crackings on molding and could not be molded well.

As descried above, he fin materials of the invention have high strength and excellent thermal conductance and can be used suitably for heat-exchanger for cars, in particular. For these and other reasons, the invention exerts remarkable effect industrially.

What is claimed is:

1. An aluminum alloy fin composition for heat-exchanger subjected to brazing, consisting essentially of 0.005 to 0.8 wt. % of Si, 0.5 to 1.5 wt. % of Fe, 0.1 to 2.0 wt. % of Ni, from about 0.001 to 0.3 wt. % of In and a balance of Al and inevitable impurities; wherein if Mg, Cu and/or Mn are present in said aluminum alloy fin composition, said Mg, Cu and/or Mn is each present in an amount less than 0.03 wt. %.

2. An aluminum alloy fin composition for heat-exchanger subjected to brazing, consisting essentially of 0.005 to 0.8 wt. % of Si, 0.5 to 1.5 wt. % of Fe, 0.1 to 2.0 wt. % of Ni, 0.01 to 0.2 wt % of Zr, and a balance of Al and inevitable impurities; wherein if Mg and/or Mn are present in said aluminum alloy fin composition, said Mg and/or Mn is each present in an amount less than 0.03 wt. %.

3. An aluminum alloy fin composition for heat-exchanger subjected to brazing, consisting essentially of 0.005 to 0.8 wt % of Si; 0.5 to 1.5 wt. % of Fe; 0.1 to 2.0 wt. % of Ni; from about 0.001 to 0.3 wt. % of In; and, optionally, at least one element of the group consisting of not more than 2.0 wt. % of Zn, and not more than 0.3 wt. % of Sn; and a balance of Al and inevitable impurities; wherein if Mg, Cu and/or Mn are present in said aluminum alloy fin composition, said Mg, Cu and/or Mn is each present in an amount less than 0.03 wt. %.

4. An aluminum alloy fin composition for heat-exchanger subjected to brazing, consisting essentially of 0.005 to 0.8 wt. % of Si; 0.5 to 1.5 wt. % of Fe; 0.1 to 2.0 wt. % of Ni; 0.01 to 0.2 wt. % of Zr; at least one element of the group consisting of not more than 2.0 wt. % of Zn, not more than 0.3 wt. % of In, and not more than 0.3 wt. % of Sn; and a balance of Al and inevitable impurities; wherein if Mg and/or Mn are present in said aluminum alloy fin composition, said Mg and/or Mn is each present in an amount less than 0.03 wt. %.

* * * * *